US009308760B2

(12) United States Patent
Kasuga et al.

(10) Patent No.: US 9,308,760 B2
(45) Date of Patent: Apr. 12, 2016

(54) PRINTER, PRINTING METHOD, AND PRINTING SYSTEM

(71) Applicant: Seiko Epson Corporation, Tokyo (JP)

(72) Inventors: Takako Kasuga, Shiojiri (JP); Yuya Iwasa, Shiojiri (JP); Toshiaki Koike, Shiojiri (JP); Kiyomi Kuroda, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/640,575

(22) Filed: Mar. 6, 2015

(65) Prior Publication Data

US 2015/0251469 A1 Sep. 10, 2015

(30) Foreign Application Priority Data

Mar. 7, 2014 (JP) ..... 2014-044763

(51) Int. Cl.

| | |
|---|---|
| ***B41J 11/00*** | (2006.01) |
| ***B41J 29/38*** | (2006.01) |
| ***B41J 3/407*** | (2006.01) |
| ***B41J 11/46*** | (2006.01) |

(52) U.S. Cl.

CPC ..... *B41J 29/38* (2013.01); *B41J 3/4075* (2013.01); *B41J 11/46* (2013.01)

(58) Field of Classification Search

USPC ..... 347/5, 9, 14, 16, 19, 104, 105.11, 164, 347/167, 168, 171, 175, 197, 198, 213, 215, 347/218, 220, 221; 400/611, 612, 624, 625; 271/258.01, 259, 261, 265.01, 265.02, 271/265.03, 270

See application file for complete search history.

(56) References Cited

U.S. PATENT DOCUMENTS

| | | | | |
|---|---|---|---|---|
| 2004/0075708 | A1* | 4/2004 | Arakawa | B41J 29/393 347/19 |
| 2006/0044381 | A1* | 3/2006 | Osakama | B41J 3/4075 347/104 |
| 2011/0316925 | A1* | 12/2011 | Saita | B41J 3/60 347/19 |
| 2012/0086747 | A1* | 4/2012 | Terada | B41J 19/145 347/9 |

FOREIGN PATENT DOCUMENTS

| | | | |
|---|---|---|---|
| JP | H05-116393 | A | 5/1993 |
| JP | 2002-326408 | A | 11/2002 |
| JP | 2002-326411 | A | 11/2002 |
| JP | 2009-154357 | A | 7/2009 |

* cited by examiner

*Primary Examiner* — Kristal Feggins
(74) *Attorney, Agent, or Firm* — Nutter McClennen & Fish LLP; John J. Penny, Jr.

(57) ABSTRACT

A printer 1 includes a conveyance unit that conveys roll paper stored in a paper feed device; a computing unit 100*a* that calculates the distance between detection marks of the roll paper conveyed by the conveyance unit; a memory unit 105 that stores a first step count corresponding to the distance between detection marks; a communication interface 106 that receives print data containing start coordinates for rendering image data of images to print in an image buffer; a print control unit 100*b* that corrects the start coordinates contained in the print data based on the distance between detection marks calculated by the computing unit 100*a* and a distance between detection marks stored in the memory unit 105; and a print unit that prints based on the print data at start coordinates corrected by the print control unit 100*b*.

7 Claims, 10 Drawing Sheets

PRINTER, PRINTING METHOD, AND PRINTING SYSTEM

Priority is claimed under 35 U.S.C. §119 to Japanese Application no. 2014-044763 filed on Mar. 7, 2014 which is hereby incorporated by reference in their entirety.

BACKGROUND

1. Technical Field

The present disclosure relates to a printer, a printing method, and a printing system.

2. Related Art

Printers that detect detection marks provided on a recording medium and apply control based on the result of detecting the detection marks are known from the literature. See, for example, JP-A-2002-326411.

JP-A-2002-326411 discloses technology for printing referenced to the position of labels and tags. However, instead of only printing referenced to the labels or tags, it is also necessary when printing to adjust the printing position inside the label or tag and print at a desired position inside the label or tag.

SUMMARY

A printer, printing method, and printing system according to the invention enable adjusting the printing position based on the result of detecting detection marks provided on the recording medium.

A printer according to the invention has a storage unit that stores a recording medium having first detection marks and second detection marks disposed at a specific interval; a conveyance unit that conveys the recording medium stored in the storage unit; a detection unit that detects the first detection marks and second detection marks of the recording medium conveyed by the conveyance unit; a computing unit that calculates the distance between detection marks based on the first detection marks and second detection marks detected by the detection unit; a memory unit that stores a predetermined distance between the first detection marks and second detection marks; a reception unit that receives print data including printing position information indicating a printing position; a print control unit that corrects the printing position information contained in the print data based on the distance between detection marks calculated by the computing unit and the distance stored in the memory unit; and a print unit that prints based on the corrected printing position information output by the print control unit.

In this aspect of the invention, the printer corrects the printing position information contained in the print data based on the distance between detection marks calculated based on the result of detecting detection marks, and the distance between detection marks stored in the memory unit. The printer can correct the printing position information and adjust the printing position using the relationship between a value stored as the distance between detection marks, and the value between detection marks actually detected by conveying the recording medium.

Preferably, the print control unit calculates a ratio between the distance between detection marks calculated by the computing unit and the distance stored in the memory unit, and corrects the printing position information based on the calculated ratio.

Thus comprised, the printer can correct the printing position information using the ratio between a value stored as the distance between detection marks, and the value between detection marks detected by actually conveying the recording medium.

Another aspect of the invention is a printing method including: receiving print data including printing position information indicating a printing position; conveying a recording medium having first detection marks and second detection marks; detecting the first detection marks and second detection marks of the conveyed recording medium; calculating the distance between detection marks based on the result of detecting the first detection marks and second detection marks; correcting the printing position information contained in the print data based on the calculated distance between detection marks and a previously stored distance between the first detection marks and second detection marks; and printing based on the corrected printing position information.

Thus comprised, the printing position information can be corrected and the printing position adjusted when printing using the relationship between a value stored as the distance between detection marks, and the value between detection marks detected by actually conveying the recording medium.

The printing method preferably also includes calculating a ratio between the calculated distance between detection marks and the previously stored distance between the first detection marks and second detection marks; and correcting the printing position information based on the calculated ratio.

Thus comprised, the printing position information can be corrected when printing using the ratio between a value stored as the distance between detection marks, and the value between detection marks detected by actually conveying the recording medium.

Another aspect of the invention is a printing system including: a control device including a transmission unit that sends print data containing printing position information indicating a position for printing; and a printer including a storage unit that stores a recording medium having first detection marks and second detection marks disposed at a specific interval; a conveyance unit that conveys the recording medium stored in the storage unit; a detection unit that detects the first detection marks and second detection marks of the recording medium conveyed by the conveyance unit; a computing unit that calculates the distance between detection marks based on the first detection marks and second detection marks detected by the detection unit; a memory unit that stores a predetermined distance between the first detection marks and second detection marks; a reception unit that receives print data including printing position information indicating a printing position; a print control unit that corrects the printing position information contained in the print data based on the distance between detection marks calculated by the computing unit and the distance stored in the memory unit; and a print unit that prints based on the corrected printing position information output by the print control unit.

In this aspect of the invention, the printer corrects the printing position information contained in the print data based on the distance between detection marks calculated based on the result of detecting detection marks, and the distance between detection marks stored in the memory unit. The printer can correct the printing position information and adjust the printing position using the relationship between a value stored as the distance between detection marks, and the value between detection marks actually detected by conveying the recording medium.

Preferably, the print control unit calculates a ratio between the distance between detection marks calculated by the computing unit and the distance stored in the memory unit, and corrects the printing position information based on the calculated ratio.

Thus comprised, the printer can correct the printing position information using the ratio between a value stored as the distance between detection marks, and the value between detection marks detected by actually conveying the recording medium.

Further preferably, the transmission unit of the control device sends the distance between the first detection marks and second detection marks stored in the memory unit of the printer.

Thus comprised, the control device manages the distance between the first detection marks and second detection marks and can store the distance in the printer.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
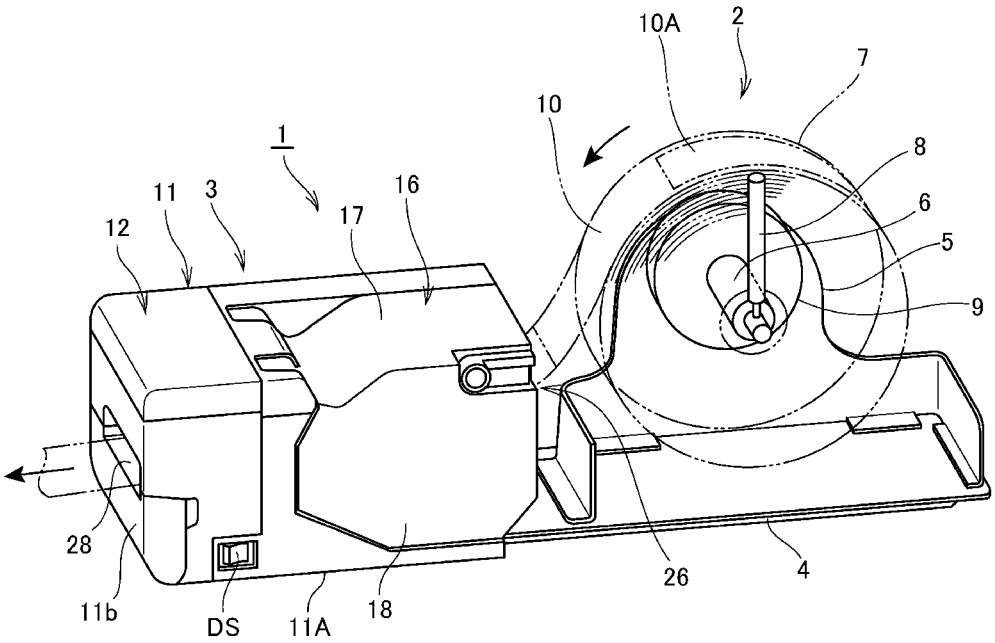
FIG. 1 is an oblique view of a printing device according to a preferred embodiment of the invention.

FIG. 1 is an oblique view of a printer 1 according to this embodiment.

The printer 1 according to this embodiment of the invention is installed at the service counter of an airline in an airport, for example, and is used to issue tickets such as baggage tags and boarding passes.

The printer 1 prints specific information on the baggage tags and boarding passes. For example, the information printed on a baggage tag may include the flight number of the plane and the name of the owner of the luggage.

An RFID (radio frequency identification) tag 10A is also embedded in the baggage tag or boarding pass. Specific information is also recorded in the RFID tag 10A by the printer 1. For example, information such as the number of the flight that is to carry the luggage (baggage) and the date and time the baggage tag was issued are recorded may be recorded in the RFID tag 10A of the baggage tag.

As shown in FIG. 1, the printer 1 has a print unit 3. A paper feed device 2 (storage unit) is connected to the print unit 3.

The paper feed device 2 holds roll paper 7 (recording media). The paper feed device 2 includes a base 4 that is removably connected to the print unit 3, a paper support unit 5 attached to the base 4, and a roll paper spindle 6 attached to the paper support unit 5. The roll paper 7 fits onto the roll paper spindle 6. A stop 8 that prevents the roll paper from slipping off the roll paper spindle 6 is attached perpendicularly to the roll paper spindle 6 at one end of the roll paper spindle 6. A disk-shaped spacer 9 for adjusting to the width of the roll paper is removably attached to the other end of the roll paper spindle 6, thereby enabling installing roll paper 7 of different widths.

Figure 2:
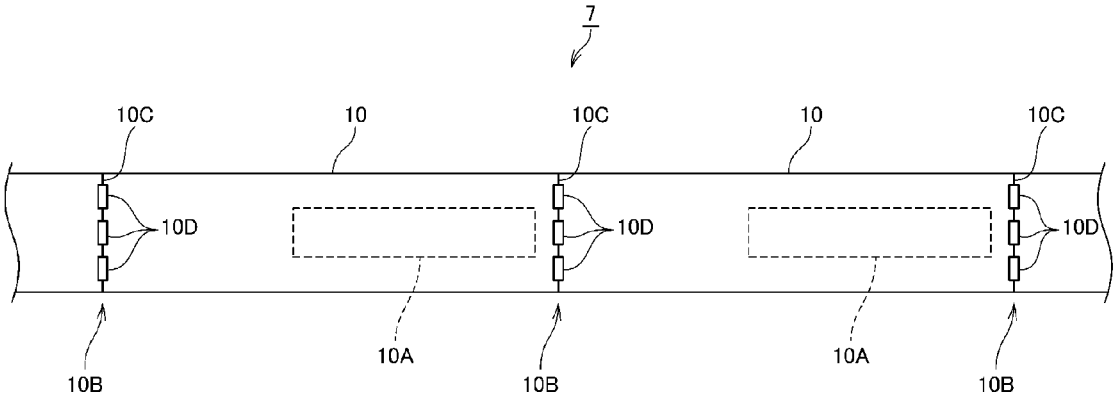
FIG. 2 illustrates an example of roll paper.

FIG. 2 shows an example of the roll paper 7.

As shown in FIG. 2, the roll paper 7 is paper with tickets 10 connected continuously in series lengthwise (the direction corresponding to the conveyance direction F). The printer 1 applies a specific process to a ticket 10 as described further below, and the ticket 10 is then severed from the roll paper 7. The ticket 10 in this example is a baggage tag. A RFID tag 10A is affixed or embedded at a specific position on the ticket 10.

As shown in FIG. 2, adjacent tickets 10 are connected at a connection part 10B. A detection part 10C is formed across the width (short side) of the roll paper 7 at the connection part 10B. As described further below, the roll paper 7 is cut at the detection part 10C by the printer 1, severing the corresponding ticket 10 from the roll paper 7. A perforation or seam may be formed at the detection part 10C to facilitate severing the ticket 10.

Three holes 10D are disposed to the detection part 10C with an interval therebetween across the width of the roll paper 7. The holes 10D are used to detect the detection part 10C by the paper detection sensor 50 (detection unit) described further below. While three holes 10D are shown in this example, the invention is not so limited.

Below, the connection part 10B located at the downstream end in the conveyance direction F of one ticket 10 when loaded in the printer 1 is referred to as the leading detection mark 10X. The connection part 10B located at the upstream end in the conveyance direction F of one ticket 10 when loaded in the printer 1 is referred to as the trailing detection mark 10Y.

The print unit 3 of the printer 1 has an outside case 11. This outside case 11 includes a main case 11A, front case 12, and cover 16. The side from which the tickets 10 are discharged is referred to as the front.

The main case 11A is the base part of the outside case 11, and other case members of the outside case 11 and the paper feed device 2 described above are attached to the main case 11A. A power switch DS that turns the power on/off is disposed to the main case 11A.

The front case 12 is a case member attached to the main case 11A. A discharge exit 28 from which the roll paper 7 is discharged is formed in the front 11*b* of the front case 12 in the middle between the top and bottom.

The cover 16 can open and close freely to the outside case 11. A paper entrance 26 through which the roll paper 7 is inserted is formed between the back end 11*a* of the outside case 11 and the front end of the cover 16.

Figure 3:
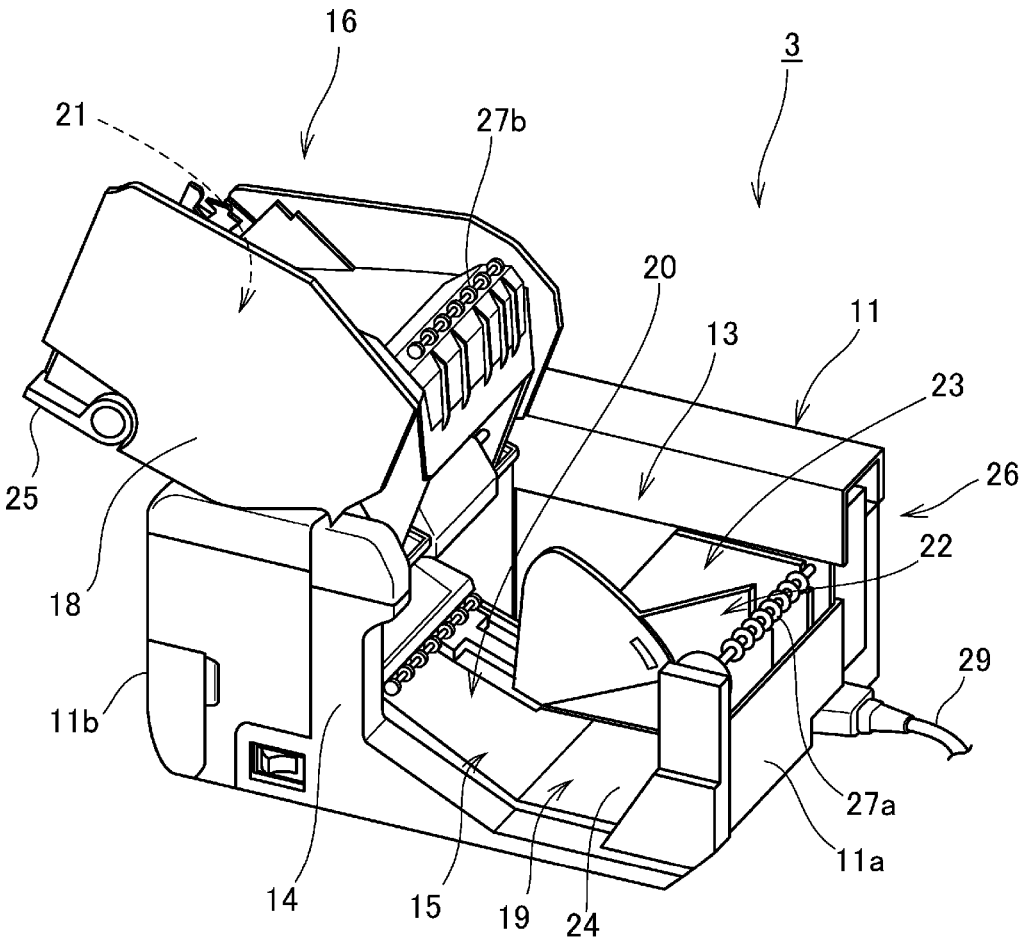
FIG. 3 is an oblique view of a printer with the cover open.

FIG. 3 is an oblique view of the print unit 3 with the cover 16 open.

As shown in FIG. 3, pivoting and opening the cover 16 exposes the top opening 13. A side opening 15 contiguous to the top opening 13 is formed in the one side 14 of the outside case 11.

When closed as shown in FIG. 1, the cover 16 covers the top opening 13 and side opening 15. The cover 16 includes a top cover part 17 (FIG. 1) that covers the top opening 13, and a side cover part 18 that covers the side opening 15. The cover 16 pivots on an axis of rotation and can open from the closed position shown in FIG. 1 to the fully open position shown in FIG. 3. When the cover 16 opens, a conveyance path 39 for the roll paper 7 loaded inside the outside case 11, and a paper stage 20 formed at the top of the conveyance path 39, are open and can be accessed from the top opening 13 and side opening 15.

As shown in FIG. 3, one side of the width of the conveyance path 39 is a first paper guide 21 formed on the inside side of the side cover part 18. The other side of the width of the conveyance path 39 is the side of either a second paper guide 22 or a third paper guide 23. When the second paper guide 22 is installed, the tickets 10 can be guided by the first paper guide 21 and second paper guide 22, and when the second paper guide 22 is removed, wide tickets 10 can be guided by the first paper guide 21 and the third paper guide 23.

A lower guide roller 27*a* is disposed to the outside case 11 inside the paper entrance 26. An upper guide roller 27*b* that is opposite the lower guide roller 27*a* when the cover 16 is in the closed position is disposed to the cover 16.

The 3 is connected to a host computer 55 described below (FIG. 5) through a USB cable 29, and exchanges data with the host computer 55.

Figure 4A:
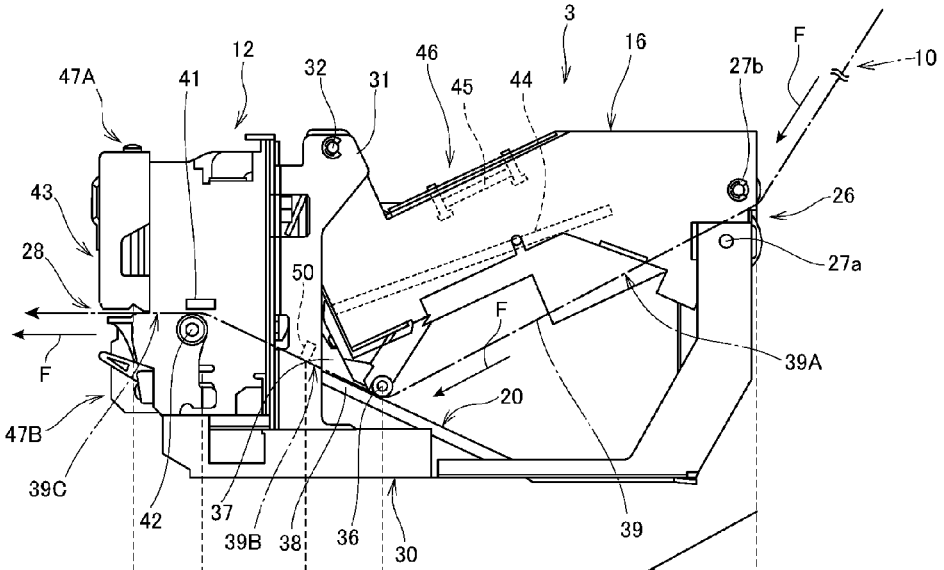
FIGS. 4A and 4B are section views illustrating the main configuration of the printer.

FIG. 4A illustrates the internal configuration of the print unit 3.

The direction from the paper entrance 26 to the paper exit 28 is the conveyance direction F. The roll paper 7 is conveyed by the printer 1 in the conveyance direction F.

The internal mechanism of the print unit 3 is configured with parts of the print unit 3 mounted on a sheet metal main frame 30 that is covered by the outside case 11. Left and right support arms 31 that extend vertically are disposed to the main frame 30, and a hinge pin 32 spans widthwise to the outside case 11 between the support arms 31. The cover 16 can pivot freely on the axis of the hinge pin 32.

A tension roller 36 extends widthwise at a position below the paper entrance 26 and in front of the paper stage 20 inside the print unit 3. The ticket 10 conveyance path 39 passing the tension roller 36 and a platen roller 42 located in front of the tension roller 36 is formed between the paper entrance 26 and paper exit 28.

The conveyance path 39 includes an upstream path slope 39A near the paper entrance 26, a downstream path slope 39B, and a horizontal path 39C further downstream near the paper exit 28. The upstream path slope 39A extends at a downward angle from the paper entrance 26 to the tension roller 36. The downstream path slope 39B slopes up to the downstream side from the tension roller 36 to the platen roller 42. The downstream path slope 39B is formed by paper guides 37, 38 disposed vertically opposite each other. The horizontal path 39C continues downstream horizontally to the front from the platen roller 42 to the paper exit 28.

A thermal head 41 that prints on the tickets 10 is disposed facing down on the downstream path slope 39B. The platen roller 42 is located below and opposite the thermal head 41. The platen roller 42 is disposed to push against the heat-emitting face of the thermal head 41. The tickets 10 are conveyed by rotation of the platen roller 42. An automatic paper cutter 43 is disposed to the horizontal path 39C near the paper exit 28, and the roll paper 7 printed by the thermal head 41 is cut by the automatic paper cutter 43.

As shown in FIG. 4A, a paper detection sensor 50 (detection unit) is disposed downstream in the conveyance direction F from the tension roller 36 and upstream in the conveyance direction F from the platen roller 42.

The paper detection sensor 50 is a transmissive photosensor disposed to detection position T1, and is disposed to a position enabling detection of the holes 10D in the roll paper 7 conveyed through the conveyance path 39. Output from the paper detection sensor 50 is sent through a specific signal processing circuit to the control unit 100 (described further below). The output value of the paper detection sensor 50 when the holes 10D are at the detection position T1, and the output value of the paper detection sensor 50 when the holes 10D in the roll paper 7 are at a position other than the detection position T1, are different. Based on change in the output value of the paper detection sensor 50, the control unit 100 detects that the detection part 10C of the roll paper 7 has reached the detection position T1.

Figure 4B:
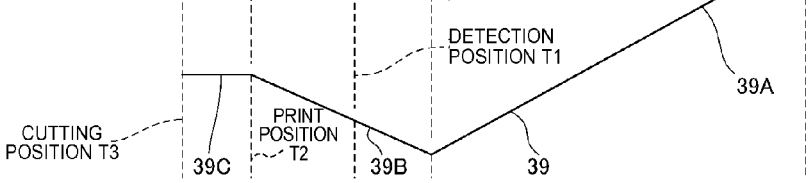

FIG. 4B illustrates the conveyance path 39 formed in the printer 1, and the detection position T1, the print position T2, and the cutting position T3 on the conveyance path 39.

The print position T2 is the position where dots are formed by the thermal head 41. The thermal head 41 forms dots on the thermal roll paper 7 by means of heat elements. The thermal head 41 has an array of multiple heat elements formed in a line extending crosswise to the conveyance direction F. The print position T2 is a position corresponding to the position of this heat element array.

The cutting position T3 is a position where the roll paper 7 is cut by the automatic paper cutter 43. The automatic paper cutter 43 cuts the roll paper 7 as a result of a movable knife intersecting with a fixed knife. The cutting position T3 is the position corresponding to the position of the movable knife.

As shown in FIG. 4B, the print position T2 of the conveyance path 39 is downstream in the conveyance direction F from the detection position T1. The cutting position T3 is downstream in the conveyance direction F from the print position T2.

A tag reader/writer 46 that writes data to and reads data from an RFID tag 10A is disposed in the outside case 11.

The tag reader/writer 46 communicates wirelessly with the RFID tag 10A by means of an antenna 44 and RF communication circuit 45. As shown in FIG. 4A, the antenna 44 is disposed facing the upstream path slope 39A. The upstream path slope 39A is the position where the tag reader/writer 46 writes data and reads data. More specifically, the tag reader/writer 46 writes data and reads data while the RFID tag 10A affixed to a ticket 10 is located in the range of the upstream path slope 39A.

An RFID tag 10A is a passive IC tag that has an antenna for receiving RF signals transmitted from an external device such as the tag reader/writer 46, and drives an IC chip by means of power induced in the antenna. The tag reader/writer 46 and RFID tag 10A in this embodiment of the invention send and receive radio signals using a specific protocol for RF tags.

To write data to or read data from the RFID tag 10A, the tag reader/writer 46 first sends a carrier wave of a specific frequency, and sends a detection signal superimposed on the carrier wave. When EMF is induced in the antenna of the RFID tag 10A by the carrier wave transmitted by the tag reader/writer 46, the IC chip of the RFID tag 10A turns on due to the induced power, receives the detection signal, and then sends a signal responding to the detection signal. When the response signal sent by the RFID tag 10A is received, the tag reader/writer 46 sets the RFID tag 10A as the target for writing data and reading data while continuing to output the carrier wave. The tag reader/writer 46 then sends a signal to start writing and reading data. Next, the tag reader/writer 46 and RFID tag 10A communicate wirelessly while the tag reader/writer 46 continues outputting the carrier wave, reads data recorded in the RFID tag 10A, and writes data to the rewritable storage area in the IC chip of the RFID tag 10A.

Figure 5:
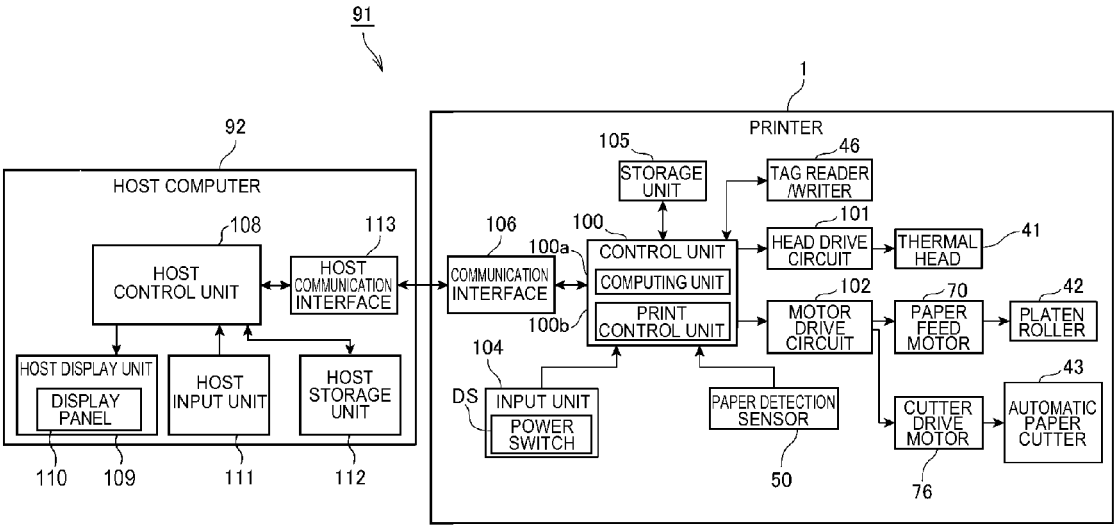
FIG. 5 is a block diagram illustrating the functional configuration of a host computer and printer.

FIG. 5 is a block diagram illustrating the functional configuration of a control system 91 according to this embodiment of the invention.

The control system 91 includes a printer 1 and a host computer 92 (control device). The host computer 92 is a computer that controls the printer 1, and can send control data instructing the printer 1 to print on the recording medium, and read and write data to the RFID tag 10A.

As shown in FIG. 5, the printer 1 has a control unit 100.

The control unit 100 includes CPU, ROM, RAM, and other peripheral circuits, and controls the printer 1. The control unit 100 controls the printer 1 by means of the CPU reading and running firmware, for example. The control unit 100 has a computing unit 100*a* and a print control unit 100*b*. These are described further below.

The control unit 100 controls the tag reader/writer 46 to read and write data to the RFID tag 10A based on data received from the host computer 92. For example, when the ticket 10 is used as a baggage tag, the control unit 100 may write data identifying the airline, airport of departure, destination airport, transiting airports, the service counter where the baggage tag was issued, the number of the boarding pass, and the flight number to the RFID tag 10A.

The control unit 100 also controls the head drive circuit 101, drives the thermal head 41, and prints images on the ticket 10.

The head drive circuit 101 and thermal head 41 together function as a print unit.

The control unit 100 also controls a motor drive circuit 102 and drives the paper feed motor 70. When the paper feed motor 70 is driven, the platen roller 42 turns and the ticket 10 is conveyed according to rotation of the platen roller 42.

The paper feed motor 70 is a stepper motor.

The paper feed motor 70 and platen roller 42 together functions as a conveyance unit.

The control unit 100 also controls the motor drive circuit 102 and drives the cutter drive motor 76. The movable knife 75 of the automatic paper cutter 43 moves and cuts the ticket 10 at the connection part 10B when the cutter drive motor 76 is driven.

The paper detection sensor 50 outputs the detection value to the control unit 100. The computing unit 100*a* of the control unit 100 detects when the detection part 10C reaches the detection position T1 while the roll paper 7 is being conveyed based on the output from the paper detection sensor 50. The computing unit 100*a* also detects (computes) the number of steps the paper feed motor 70 must drive for the next detection part 10C to reach the detection position T1 after detecting that the detection part 10C reached the detection position T1 based on the output from the paper detection sensor 50 while the roll paper 7 is being conveyed.

The input unit 104 includes a power switch DS and other switches, detects operation thereof, and outputs to the control unit 100.

The memory unit 105 includes EEPROM or other nonvolatile memory, and nonvolatilely stores data. The data the memory unit 105 stores is described further below.

The communication interface 106 (reception unit) communicates with the host computer 92 according to specific communication protocol as controlled by the control unit 100. The communication interface 106 receives control data sent from the host computer 92 as controlled by the control unit 100.

As shown in FIG. 5, the host computer 92 includes a host control unit 108.

The host control unit 108 has a CPU, ROM, RAM, and other peripheral circuits, and controls the host computer 92.

The host display unit 109 has an LCD panel or other display panel 110, and displays images on the display panel 110 as controlled by the host control unit 108.

The host input unit 111 is connected to operating switches or input devices, detects operation of the operating switches or input devices, and outputs to the host control unit 108.

The host memory unit 112 includes EEPROM, a hard disk drive, or other nonvolatile memory, and stores data.

The host communication interface 113 (transmission unit) communicates with the printer 1 according to a specific communication protocol as controlled by the host control unit 108.

Figure 6:
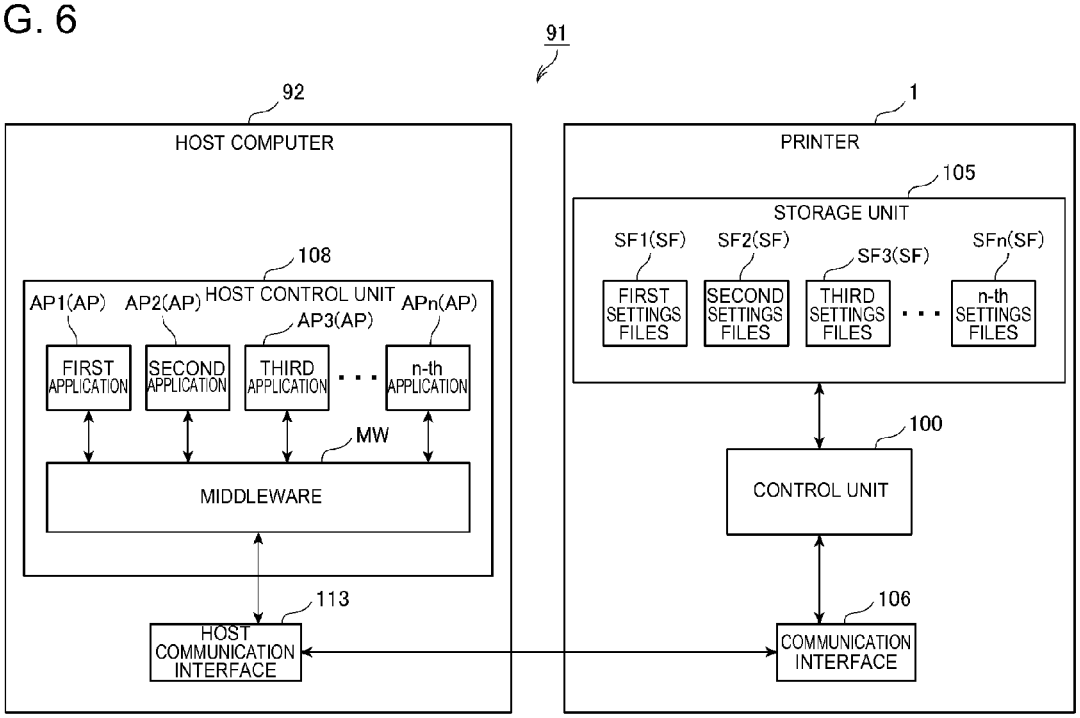
FIG. 6 is a function block diagram of the main parts of the host computer and printer.

FIG. 6 is a function block diagram showing main parts of the printer 1 and host computer 92.

Multiple applications AP (first application AP1 to n-th application APn) are installed in the host computer 92, and any of the applications can be selectively started and run.

In this example as described above, the printer 1 is installed at the service counter of an airline in an airport, and multiple airlines may share one printer 1 and a control system 91 including the printer 1.

When multiple airlines share a single control system 91, each airline uses the printer 1 to produce baggage tags and boarding passes through functions of a dedicated application. An application AP for each airline is therefore pre-installed to the host computer 92.

In this example, n applications AP referred to as application 1 to application n are pre-installed as the applications AP respectively used by airline 1 to airline n. FIG. 6 shows an example in which one of the multiple applications AP has started and can run.

The application AP has a function for generating data ("write data" below) including the information to be written to the RFID tag 10A of the ticket to be issued, and data ("print data" below) including information related to the image to be printed on the ticket, when producing a ticket.

In FIG. 6, the middleware MW represents software that functions as an interface between the applications AP and the operating system of the host computer 92. More specifically, the middleware MW in this embodiment functions as a device driver for controlling the printer 1. The middleware MW has functions for generating and sending control data to the printer 1 based on the received process data when process data including the write data and print data described above is received from an application AP. The control data is data conforming to the command language of the printer 1. Print control data and write control data are included in the control data. In this example, the print data is data conforming to the command language of printer 1, and is data instructing printing an image. The write control data is also data conforming to the command language of printer 1, and is data instructing writing data to the RFID tag 10A.

To produce a ticket, the application AP therefore generates write data and print data, and outputs process data including the foregoing data to the middleware MW according to a protocol.

As also shown in FIG. 6, multiple settings files SF (a first settings file SF1 to an n-th settings file SFn) are stored in the memory unit 105 of the printer 1.

A settings file SF is a file storing the values of various print settings. The print settings include, for example, the print speed, print density, margins, and start printing position. Information specifying the operating mode ("operating mode information" below) is also recorded as one setting in the settings files SF.

The control unit 100 reads the settings files SF and operates in the specified operating mode. The control unit 100 also prints according to the values of the settings contained in the settings files SF.

As shown in FIG. 6, a settings files SF is stored for each application AP. In the example in FIG. 6, the n-th settings file SFn is the settings file SF for the n-th application APn. The airline company pre-installs a settings file SF with the desired values in the memory unit 105 of the printer 1. Storing a settings file SF for an airline is done through a user interface that is provided by a function of the application AP or middleware MW, for example. Further alternatively, a software tool for printer 1 maintenance could be used.

The basic operation of the printer 1 and host computer 92 when processing one ticket 10 of the roll paper 7 is described next.

The host control unit 108 of the host computer 92 generates and sends control data to the printer 1 by means of a specific application AP and middleware MW. Print data and write control data are contained in the control data.

The control unit 100 of the printer 1 executes the following process based on the received control data.

The control unit 100 controls the motor drive circuit 102 to drive the paper feed motor 70 and convey the ticket 10 in the conveyance direction F.

While conveying the ticket 10 in the conveyance direction F, the control unit 100 controls the tag reader/writer 46 based on the write control data contained in the control data and writes data to the RFID tag 10A. Based on the print data contained in the control data, the control unit 100 also controls the head drive circuit 101 and mechanism to print on the surface of the ticket 10.

After finishing writing data to the RFID tag 10A and printing on the ticket 10, the control unit 100 executes the following process. The control unit 100 controls the motor drive circuit 102 to drive the paper feed motor 70, and conveys the ticket 10 to position the trailing detection mark 10Y of the ticket 10 to the cutting position T3. Next, the control unit 100 controls the motor drive circuit 102 to drive the cutter drive motor 76, and cuts the ticket 10 at the trailing detection mark 10Y by the automatic paper cutter 43. As a result, the ticket 10 is severed from the roll paper 7 and one ticket is issued.

The operation whereby the printer 1 advances the roll paper 7 and prints on the roll paper 7 is described next.

If the type of roll paper 7 set in the printer 1 is different, the distance the roll paper 7 is actually conveyed may differ when the same number of pulse signals is sent to the paper feed motor 70, which is a stepper motor, due to differences in the material of the roll paper 7.

The printer 1 therefore executes the following process.

Figure 7:
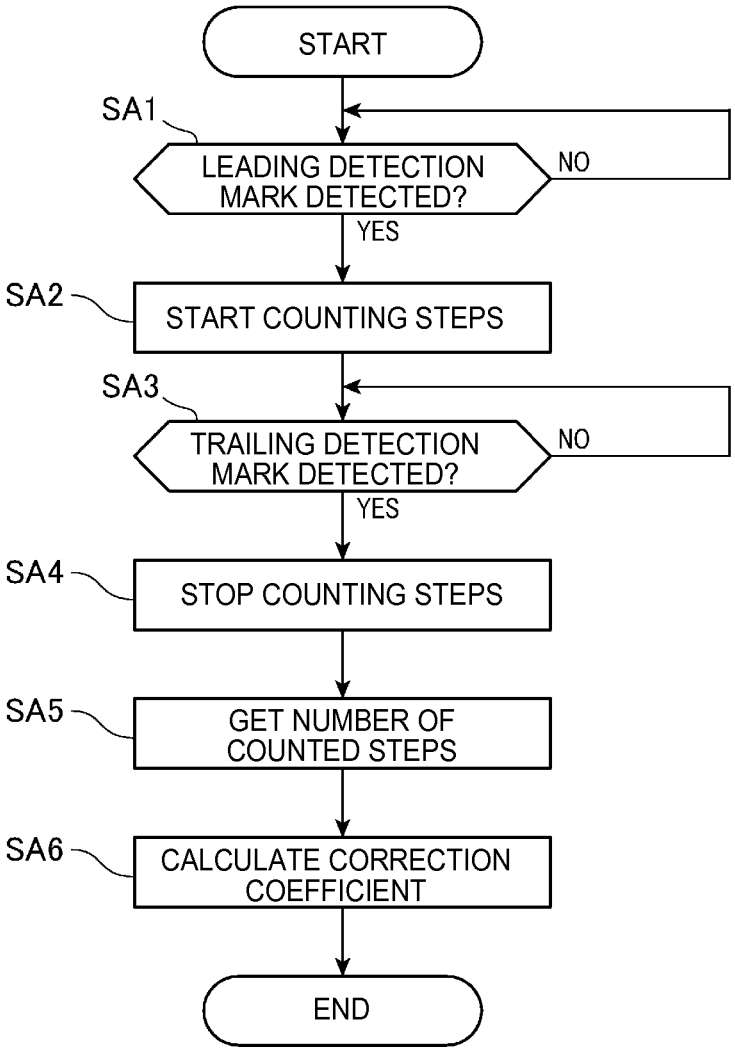
FIG. 7 is a flow chart illustrating the operation of the printer.

FIG. 7 (step SI a flow chart describing the operation of the printer 1 when conveying the roll paper 7.

The printer 1 may apply the process shown in the flow chart of FIG. 7 to the first ticket 10 to be processed after roll paper 7 conveyance starts, or to plural tickets 10 of the roll paper 7.

The process of printing with the thermal head 41 and the process of writing data to the RFID tag 10A by the tag reader/writer 46 are omitted from the flow chart in FIG. 7.

In the following description, outputting one pulse signal to the paper feed motor 70, which is a stepper motor, and turning the motor shaft one step angle is referred to as causing the paper feed motor 70 to turn one step. As known from the literature, the motor shaft of a stepper motor turns one step angle (0.72 degree in this example) in response to the input of one pulse signal.

The number of steps the paper feed motor 70 turns from when the leading detection mark 10X of one ticket 10 is detected to reach the detection position T1 until the trailing detection mark 10Y of the one ticket 10 reaches the detection position T1 is measured by the process shown in the flow chart in FIG. 7. Below, the ticket 10 for which the number of steps is measured is referred to as the target ticket 10Q and distinguished from the other tickets 10.

As shown in FIG. 7, during conveyance of the roll paper 7, the computing unit 100*a* of the control unit 100 of the printer 1 detects if the leading detection mark 10X of the target ticket 10Q is at the detection position T1 based on the output value of the paper detection sensor 50 (step SA1).

Figure 8A:
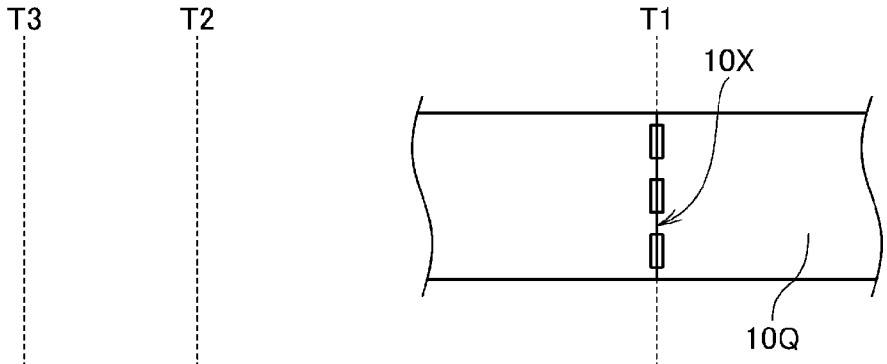
FIGS. 8A and 8B illustrate the relationship between roll paper and the detection position.

FIGS. 8A and B illustrate the detection position T1, print position T2, and cutting position T3, and show the relationship between these positions and the position of the target ticket 10Q.

FIG. 8A illustrates when the leading detection mark 10X of the target ticket 10Q is at the detection position T1. In step SA1, the computing unit 100*a* detects that the target ticket 10Q is positioned as shown in FIG. 8A.

When the leading detection mark 10X of the target ticket 10Q is detected at the detection position T1 in step SA1 (step SA1 returns YES), the computing unit 100*a* starts counting the number of steps the paper feed motor 70 turns (step SA2). For example, the computing unit 100*a* counts the number of steps by incrementing an integer counter that starts at 0 each time the paper feed motor 70 turns one step.

Next, the computing unit 100*a* detects whether or not the trailing detection mark 10Y of the target ticket 10Q has reached the detection position T1 based on the output value of the paper detection sensor (step SA3).

Figure 8B:
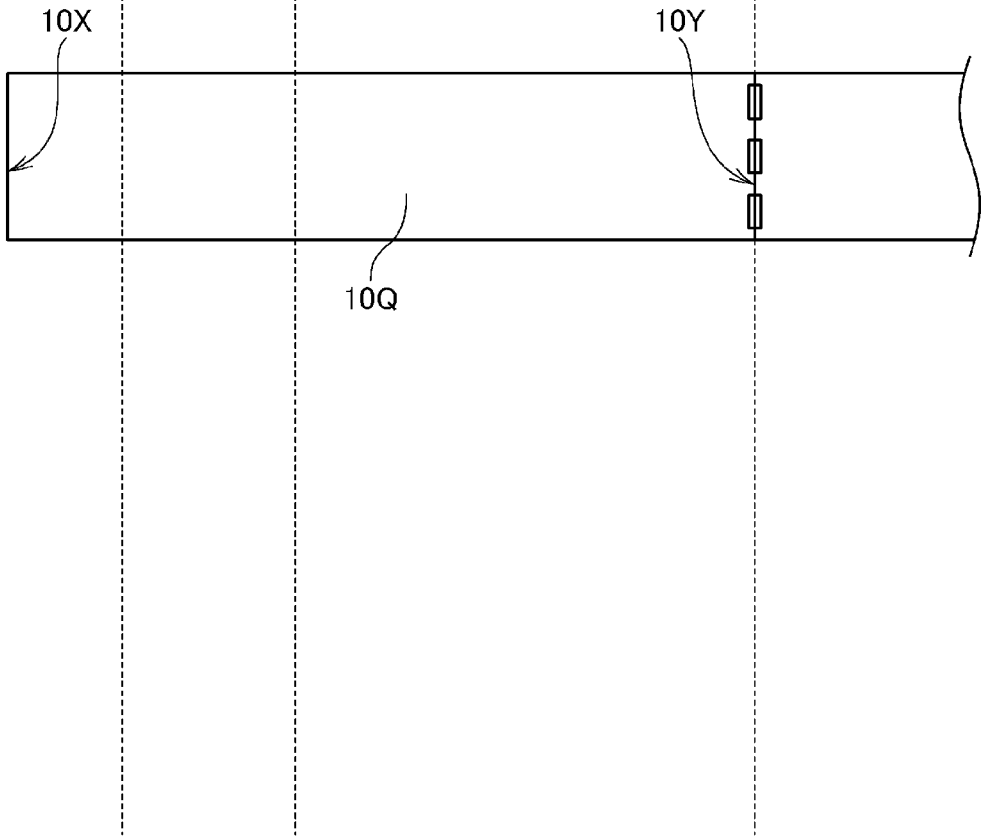

FIG. 8B shows when the trailing detection mark 10Y of the target ticket 10Q is positioned to the detection position T1. The computing unit 100*a* detects when the target ticket 10Q is positioned as shown in FIG. 8B in step SA3.

When the trailing detection mark 10Y of the target ticket 10Q is detected at the detection position T1 in step SA3 (step SA3 returns YES), the computing unit 100*a* stops counting the number of steps of the paper feed motor 70 (step SA4).

The number of steps of the paper feed motor 70 counted by the computing unit 100*a* is the number of steps of the paper feed motor 70 required for the trailing detection mark 10Y of the target ticket 10Q to reach detection position T1 after the leading detection mark 10X reached the detection position T1.

By counting the number of steps required for the trailing detection mark 10Y (second detection mark) to be detected after the leading detection mark 10X (first detection mark) is detected by the paper detection sensor 50 as described above, the computing unit 100*a* calculates the distance (the distance between the detection marks) between the leading detection mark 10X and trailing detection mark 10Y.

Next, the print control unit 100*b* of the control unit 100 gets the number of steps of the paper feed motor 70 counted by the computing unit 100*a* (step SA5). The number of steps acquired in step SA5 is referred to below as the number of counted steps.

Next, the print control unit 100*b* calculates a correction coefficient based on the acquired number of counted steps (step SA6).

The print control unit 100*b* calculates the correction coefficient as described below in step SA6.

The number of steps ("first step count" below) the paper feed motor 70 must turn to convey the tickets ("ticket 10P" below) of a specific paper roll ("calibration roll paper 7P" below) the distance corresponding to the length of the ticket 10P in the conveyance direction is stored in the memory unit 105 of the printer 1. The value of this first step count may be determined by loading the calibration roll paper 7P and measuring the count using the paper feed motor 70 when the printer 1 is manufactured, for example. The first step count is the number of steps the paper feed motor 70 must turn to convey a ticket 10P of the calibration roll paper 7P the distance equal to the length of the ticket 10P in the conveyance direction.

The number of counted steps corresponds to the "distance between detection marks", and the first step count corresponds to the "predetermined distance between a first detection mark and a second detection mark."

The first step count and the number of counted steps may not match due to differences between material of the calibration roll paper 7P and the material of the roll paper 7 actually loaded in the printer 1.

The length of the tickets 10 of the roll paper 7 may differ according to the type (standard), and a first step count is stored in the memory unit 105 for each type. The print control unit 100*b* gets the type of the roll paper 7 that is loaded by a particular means, and calculates the correction coefficient as described below using the first step count appropriate to the type.

In step SA6, the print control unit 100*b* uses the following equation 1 to calculate the correction coefficient.

$$\text{correction coefficient} = \text{number of counted steps} / \text{first step count} \qquad \text{Equation 1:}$$

If the number of counted steps is 101, and the first step count is 100, the correction coefficient in this example is 1.01.

How this correction coefficient is used is described further below.

Operation of the printer 1 when printing a ticket 10 of the roll paper 7 is described next.

Figure 9:
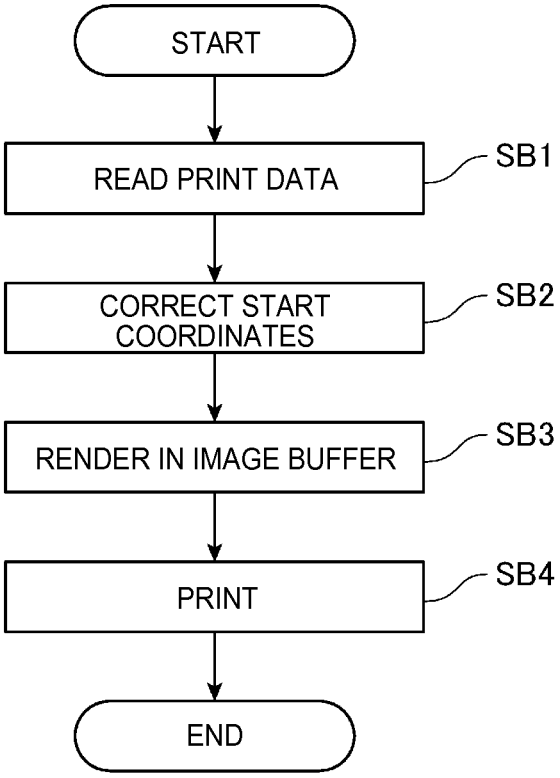
FIG. 9 is a flow chart illustrating the operation of the printer.

FIG. 9 is a flow chart describing the operation of the printer 1 when printing one ticket 10. Note that below the ticket 10 to be printed is referred to as the print target ticket 10, and differentiated from the other tickets 10.

Furthermore, when the operation shown in the flow chart in FIG. 9 starts, the correction coefficient has already been calculated.

As shown in FIG. 9, to print the print target ticket 10, the print control unit 100*b* of the control unit 100 of the printer 1 reads the print data instructing printing the print target ticket 10 (step SB1). As described above, the print data is contained in the control data sent by the host computer 92. The host control unit 108 of the host computer 92 generates control data containing the print data, and controls the host communication interface 113 (transmission unit) to send the control data to the printer 1. The printer 1 stores the control data received from the host computer 92 in the receive buffer.

The print data instructing printing a print target ticket 10 contains the following information. The image to be printed on the print target ticket 10 and the data rendered in the receive buffer to print the image are described with reference to a specific example below, and the information contained in the print data is then described. The image buffer is a temporary storage area created in RAM. Image data corresponding to the image to be printed is rendered in the image buffer.

Figure 10A:
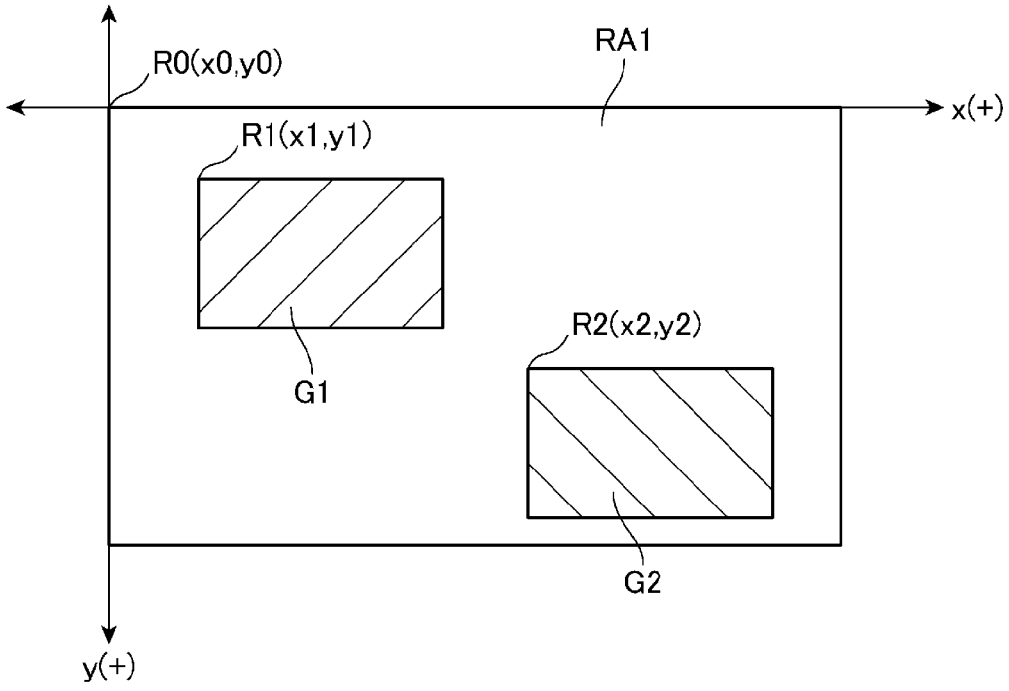
FIG. 10A illustrates an image printed on a ticket, and FIG. 10B illustrate the print data rendered in a print buffer.

FIG. 10A illustrates an example of an image printed in the print area RA1 of the print target ticket 10.

In FIG. 10A, the print area RA1 is an area in a coordinate system having a left-right x-axis and a vertical y-axis with the corner at the top left of the print area RA1 in the figure as the origin at (R0 (x0, y0)).

In the example shown in FIG. 10A, two images, image G1 and image G2, are printed in the print area RA1. Image G1 is an image printed with its origin at point R1 (x1, y1). Image G2 is an image printed with its origin at point R2 (x2, y2).

Figure 10B:
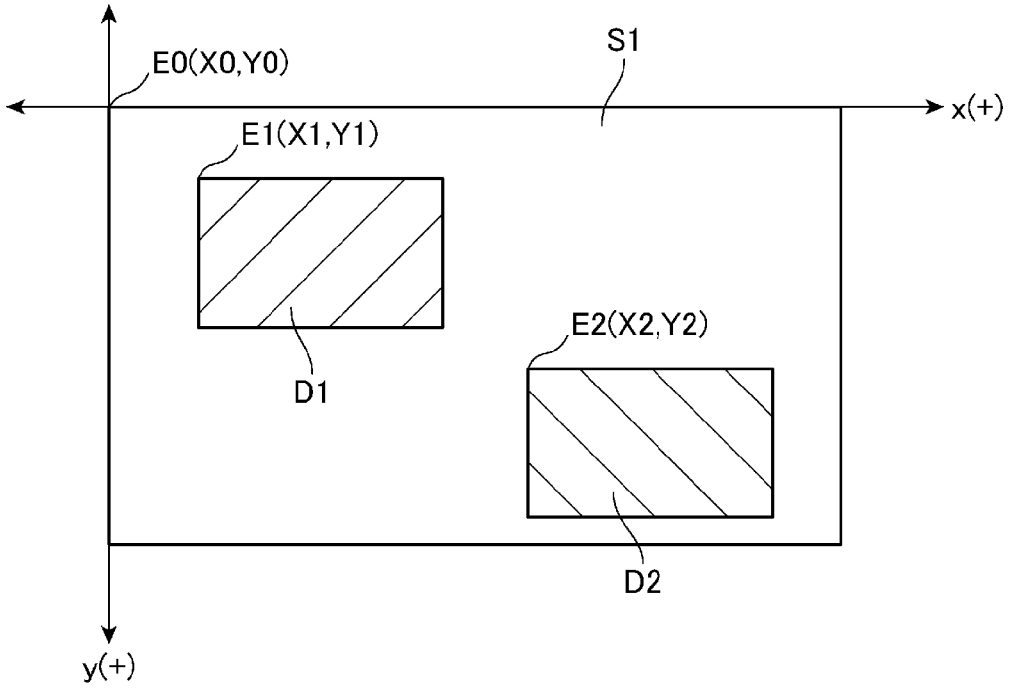

FIG. 10B illustrates the data rendered in the image buffer to print the image shown in FIG. 10A.

In the example shown in FIG. 10B, rendering area S1 is an area in a coordinate system having a left-right x-axis and a vertical y-axis with the corner at the top left of the rendering area S1 in the figure as the origin at (E0 (X0, Y0)).

In FIGS. 10A and 10B, the direction to the right on the x-axis is positive (+) on the x-axis, and the direction to the bottom on the y-axis is positive (+) on the y-axis. The image data rendered in the rendering area S1 is data storing information related to the color of each dot in a dot matrix array as a gray scale value, for example. The position of each dot in the image data rendered in the rendering area S1 is expressed by coordinates in the coordinate system.

In the example shown in FIG. 10B, image data D1 for image G1 and image data D2 for image G2 is rendered in the rendering area S1.

Image data D1 is rendered in the rendering area S1 with its origin at point E1 (X1, Y1) corresponding to point R1 (x1, y1) above.

Image data D2 is rendered in the rendering area S1 with its origin at point E2 (X2, Y2) corresponding to point R2 (x2, y2) above.

The print data instructing printing a print target ticket 10 includes information (printing position information, referred to below as "start coordinates") identifying the coordinates of the starting point for rendering the image data of the image to print in the rendering area S1. If image data for printing plural images is received, the print data includes information identifying the start coordinates for rendering the image data of each image to print in the rendering area S1.

When printing images as shown in FIG. 10A, for example, the print data includes information identifying the coordinates of the starting point for rendering the image data D1 for image G1 in the rendering area S1, and information identifying the coordinates of the starting point for rendering the image data D2 for image G2 in the rendering area S1.

As shown in FIG. 9, the print control unit 100*b* then corrects the start coordinates (printing position information) based on the correction coefficient (step SB2).

More specifically, the print control unit 100*b* multiplies the value of the x-coordinate of the start coordinates of the image data (below, the starting x-coordinate) by the correction coefficient. The print control unit 100*b* then makes the resulting product (referred to below as the "corrected x-coordinate") of the starting x-coordinate and the correction coefficient the x-coordinate of the new start coordinates for the image data (referred to below as the "corrected start coordinates").

For example, when information identifying E1 (X1, Y1) as the start coordinates for rendering image data D1, and information identifying E2 (X2, Y2) as the start coordinates for rendering image data D2, is contained in the print data as shown in FIG. 10B, the print control unit 100*b* executes the following process.

The print control unit 100*b* corrects the start coordinates E1 (X1, Y1) based on the correction coefficient and computes the corrected start coordinates E1' (correction coefficient*X1, Y1).

The print control unit 100*b* also corrects the start coordinates E2 (X2, Y2) based on the correction coefficient and computes the corrected start coordinates E2' (correction coefficient*X2, Y2).

For example, if the start coordinates E1 (X1, Y1) are E1 (100, 50), and the correction coefficient is 1.01, the corrected start coordinates become E1' (101, 50).

As described above, if the type of roll paper 7 set in the printer 1 changes, the distance that the roll paper 7 is actually conveyed may differ due to differences in the roll paper 7 material even though the paper feed motor 70 is turned the same number of steps. As a result, the start coordinates contained in the print data are corrected based on a correction coefficient to produce corrected start coordinates. By then rendering the image data in the image buffer based on the corrected start coordinates, the position of the printed image shifts to reflect the difference in the material of the roll paper 7, and the image can be printed at a more accurate position on the ticket 10. As a result, the print control unit 100*b* corrects the start coordinates based on the correction coefficient and creates corrected start coordinates in step SB2.

Next, the print control unit 100*b* renders the image data in the image buffer based on the corrected start coordinates (step SB3). When there is image data for plural images to print, the print control unit 100*b* renders the image data for each image based on the corresponding start coordinates.

Next, the print control unit 100*b* controls the print unit (head drive circuit 101, thermal head 41, and associated mechanisms and devices) based on the image data rendered in the image buffer, and prints (step SB4). In step SB4, images are printed on the ticket 10 at a more accurate position on the ticket 10 regardless of differences in the material of the roll paper 7.

The timing for calculating the correction coefficient and the timing for using the calculated correction coefficient are as described below, for example.

In one example, the print control unit 100*b* calculates the correction coefficient based on the number of steps counted for one specific ticket 10 (such as the first ticket 10 to be processed) in the tickets 10 on the roll paper 7. Based on the calculated correction coefficient, the print control unit 100*b* then corrects the start coordinates for the plural tickets 10 of the roll paper 7.

Further alternatively, the print control unit 100*b* may calculate the correction coefficient based on the number of counted steps counted for each of plural tickets 10 of the roll paper 7. Based on the correction coefficient calculated based on the number of steps counted for one ticket 10, the print control unit 100*b* then corrects the start coordinates for the images printed on the ticket 10 next upstream in the conveyance direction F contiguous to the one ticket 10. This is described for printing images on each ticket 10 of roll paper 7 having four tickets 10, a first ticket, second ticket, third ticket, and fourth ticket, connected one after the other on the upstream side in the conveyance direction F.

In this example, the print control unit 100*b* corrects the start coordinates for the image printed on the second ticket based on the correction coefficient calculated from the number of counted steps of the first ticket. The print control unit 100*b* corrects the start coordinates for the image printed on the third ticket based on the correction coefficient calculated from the number of steps counted for the second ticket. The print control unit 100*b* then corrects the start coordinates for the image printed on the fourth ticket based on the correction coefficient calculated from the number of steps counted for the third ticket. Note that the start coordinates are corrected based on a default correction coefficient for images printed on the first ticket. The correction coefficient is not calculated based on the fourth ticket.

As described above, a printer 1 according to this embodiment has a paper feed device 2 that stores roll paper 7 (recording medium) having detection parts 10C disposed at a specific interval; a conveyance unit (including a paper feed motor 70 and platen roller 42) that conveys the roll paper 7 stored in the paper feed device 2; a paper detection sensor 50 (detection unit) that detects the detection parts 10C (first detection mark, second detection mark) of the roll paper 7 conveyed by the conveyance unit; a computing unit 100*a* that calculates the distance between detection marks based on the detection result of the detection parts 10C by the paper detection sensor 50; a memory unit 105 that stores a first step count corresponding to the distance between detection parts 10C; a communication interface 106 (reception unit) that receives print data including start coordinates (printing position information indicating the position of an image to be printed) for rendering image data of the image to print in an image buffer; a print control unit 100*b* that corrects the start coordinates contained in the print data based on the distance between detect ion parts 10C detected by the computing unit 100*a* and the distance between detection parts 10C stored in the memory unit 105; and a print unit (including a head drive circuit 101 and thermal head 41) that prints based on the print data at the start coordinates corrected by the print control unit 100*b*.

Thus comprised, the printer 1 corrects the start coordinates contained in the print data based on the distance between detection parts 10C detected by the computing unit 100*a* and the distance between detection parts 10C stored in the memory unit 105. As a result, the printer 1 can correct the start coordinates and adjust the printing position based on the result of detecting the detection parts 10C in the roll paper 7 by using the relationship between the value stored as the distance between detection parts 10C and the value of the distance between detection parts 10C detected by actually conveying the roll paper 7.

The print control unit 100*b* also corrects the start coordinates based on the distance (number of counted steps) between detection parts 10C detected by the computing unit 100*a* and the distance (first step count) between detection parts 10C stored in the memory unit 105.

Thus comprised, the printer 1 can correct the start coordinates using the ratio between the value stored as the distance between detection parts 10C and the value of the distance between detection parts 10C detected by actually conveying the roll paper 7.

The invention is described above with reference to a preferred embodiment thereof, but the invention is not limited thereto and can be modified and adapted in many ways without departing from the scope of the accompanying claims.

For example, the host computer 92 may manage the first step count, and send data including the first step count to the printer 1 at a specific time to store the first step count in the printer 1.

For example, the computing unit 100*a* in this embodiment measures the conveyance distance of the roll paper 7 by detecting the number of steps the paper feed motor 70 turns. Alternatively, a rotary encoder may be disposed to the paper feed motor 70, and the conveyance distance of the roll paper 7 measured based on the output of the rotary encoder.

Further alternatively, the printer 1 may be configured to execute the foregoing process when the operating mode is set to a specific operating mode.

The detection marks that are detected are also not limited to the type of marks described above. For example, black marks may be formed on the reverse side of the roll paper 7 as the detection marks.

The function blocks shown in FIG. 5 can also be achieved by the cooperation of hardware and software, and do not suggest a specific hardware configuration. Functions of the printer 1 may also be embodied in another device externally connected to the printer 1. The printer 1 may also be configured to execute the foregoing processes by running a program stored on an externally connected storage medium.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A printer comprising:

a storage unit that stores a recording medium having first detection marks and second detection marks disposed at a specific interval;

a conveyance unit that conveys the recording medium stored in the storage unit;

a detection unit that detects the first detection marks and second detection marks of the recording medium conveyed by the conveyance unit;

a computing unit that calculates the distance between detection marks based on the first detection marks and second detection marks detected by the detection unit;

a memory unit that stores a predetermined distance between the first detection marks and second detection marks;

a reception unit that receives print data including printing position information indicating a printing position;

a print control unit that corrects the printing position information contained in the print data based on the distance between detection marks calculated by the computing unit and the distance stored in the memory unit; and a print unit that prints based on the corrected printing position information output by the print control unit.

2. The printer described in claim 1, wherein:

the print control unit calculates a ratio between the distance between detection marks calculated by the computing unit and the distance stored in the memory unit, and corrects the printing position information based on the calculated ratio.

3. A printing method comprising:

receiving print data including printing position information indicating a printing position;

conveying a recording medium having first detection marks and second detection marks;

detecting the first detection marks and second detection marks of the conveyed recording medium;

calculating the distance between detection marks based on the result of detecting the first detection marks and second detection marks;

correcting the printing position information contained in the print data based on the calculated distance between detection marks and a previously stored distance between the first detection marks and second detection marks; and printing based on the corrected printing position information.

4. The printing method described in claim 3, further comprising:

calculating a ratio between the calculated distance between detection marks and the previously stored distance between the first detection marks and second detection marks; and correcting the printing position information based on the calculated ratio.

5. A printing system comprising:

a control device including a transmission unit that sends print data containing printing position information indicating a position for printing; and a printer including a storage unit that stores a recording medium having first detection marks and second detection marks disposed at a specific interval;

a conveyance unit that conveys the recording medium stored in the storage unit;

a detection unit that detects the first detection marks and second detection marks of the recording medium conveyed by the conveyance unit;

a computing unit that calculates the distance between detection marks based on the first detection marks and second detection marks detected by the detection unit;

a memory unit that stores a predetermined distance between the first detection marks and second detection marks;

a reception unit that receives print data including printing position information indicating a printing position;

a print control unit that corrects the printing position information contained in the print data based on the distance between detection marks calculated by the computing unit and the distance stored in the memory unit; and a print unit that prints based on the corrected printing position information output by the print control unit.

6. The printing system described in claim 5, wherein:

the print control unit calculates a ratio between the distance between detection marks calculated by the computing unit and the distance stored in the memory unit, and corrects the printing position information based on the calculated ratio.

7. The printing system described in claim 5, wherein:

the transmission unit of the control device sends the distance between the first detection marks and second detection marks stored in the memory unit of the printer.

* * * * *